US008955595B2

(12) United States Patent
Emecheta et al.

(10) Patent No.: US 8,955,595 B2
(45) Date of Patent: Feb. 17, 2015

(54) APPARATUS AND METHOD FOR PROVIDING A CONTROLLABLE SUPPLY OF FLUID TO SUBSEA WELL EQUIPMENT

(75) Inventors: Chukwuemeka U. Emecheta, Richmond, TX (US); Thomas E. O'Donnell, Houston, TX (US); Omid Oujani, Houston, TX (US); Hailing An, Houston, TX (US); Baha T. Tanju, Houston, TX (US); George Siappas, Houston, TX (US)

(73) Assignee: Chevron U.S.A. Inc., San Ramon, CA (US)

( * ) Notice: Subject to any disclaimer, the term of this patent is extended or adjusted under 35 U.S.C. 154(b) by 674 days.

(21) Appl. No.: 12/621,341

(22) Filed: Nov. 18, 2009

(65) Prior Publication Data

US 2011/0114329 A1 May 19, 2011

(51) Int. Cl.

*E21B 43/01* (2006.01)
*F15B 1/02* (2006.01)
*E21B 33/035* (2006.01)

(52) U.S. Cl.

CPC ..... *E21B 33/0355* (2013.01)
USPC ..... 166/350; 166/351; 166/338; 166/339; 60/413; 60/415

(58) Field of Classification Search

CPC ..... E21B 33/0355; E21B 33/037; E21B 41/0007; F03B 13/10; F03B 23/00; F04B 23/00; B63C 11/52
USPC ..... 166/335, 338, 339, 319, 344, 350, 351, 166/357, 369, 375; 60/413, 415
See application file for complete search history.

(56) References Cited

U.S. PATENT DOCUMENTS

| | | | | |
|---|---|---|---|---|
| 3,604,456 | A * | 9/1971 | Jones | 137/594 |
| 4,112,687 | A * | 9/1978 | Dixon | 60/641.6 |
| 4,378,848 | A | 4/1983 | Milberger | |
| 4,442,902 | A * | 4/1984 | Doremus et al. | 166/374 |
| 6,102,124 | A | 8/2000 | Skeels et al. | |
| 6,202,753 | B1 * | 3/2001 | Baugh | 166/364 |

(Continued)

OTHER PUBLICATIONS

PCT Notification of Transmittal of the International Search Report and the Written Opinion of the International Searching Authority, or the Declaration, dated May 26, 2011 (8 pages).

(Continued)

*Primary Examiner* — James G Sayre
(74) *Attorney, Agent, or Firm* — Nicholas F. Gallo; Melissa Patangia

(57) ABSTRACT

An apparatus and method for providing a controllable supply of fluid, and optionally power and/or communication signals, to a subsea equipment are provided. The fluid may be a water-based fluid, oil-based fluid, or chemicals. The apparatus includes a reservoir disposed on a seabed for storing a supply of fluid for delivery to the subsea well equipment. A subsea pumping device is configured to receive the fluid from the reservoir, pressurize the fluid, and deliver the pressurized fluid to an accumulator of a hydraulic power unit disposed on the seabed. The hydraulic power unit can store the pressurized fluid and control an output of the pressurized fluid to the subsea well equipment, thereby providing a subsea fluid source for the subsea equipment.

9 Claims, 12 Drawing Sheets

(56) References Cited

U.S. PATENT DOCUMENTS

| | | | | |
|---|---|---|---|---|
| 6,817,418 | B2 | 11/2004 | Gatherar et al. | |
| 6,840,088 | B2 * | 1/2005 | Tucker et al. | 73/49.5 |
| 2003/0094419 | A1 * | 5/2003 | Vickio, Jr. | 210/741 |
| 2005/0178557 | A1 | 8/2005 | Johansen et al. | |
| 2006/0083624 | A1 | 4/2006 | Cunningham et al. | |
| 2006/0231265 | A1 | 10/2006 | Martin | |

OTHER PUBLICATIONS

ROV Workover Control System (RWOCS), Oceaneering, found at http://www.oceaneering.com/oceandocuments/brochures/subseaproducts/dts/DTS%20-%20ROV%20Workover%20Control%20Systems%20(RWOCS).pdf.

* cited by examiner

APPARATUS AND METHOD FOR PROVIDING A CONTROLLABLE SUPPLY OF FLUID TO SUBSEA WELL EQUIPMENT

BACKGROUND OF THE INVENTION

1. Field of the Invention

This invention relates to the provision of pressurized fluids used in well operations and, more particularly, to an apparatus and method for providing a controllable supply of fluid, and optionally electrical power and/or communication signals, to a subsea well equipment.

2. Description of Related Art

In the production of fluids from a subsea hydrocarbon reservoir, it is often desired to perform a workover operation to improve or verify certain performance of the well and/or the subsea equipment associated with its operation, such as a subsea Christmas tree, i.e., an assembly of valves, spools, and fittings, used for controlling the operations of a subsea well. For example, in a typical workover operation, the operations of the subsea Christmas tree can be controlled without the well's production system in operation to determine if the tree is operating correctly. Such a workover operation can be performed after the well has been in production for some time, or a similar operation can be performed just prior to completion and production operation of the subsea well.

A conventional method for performing such a workover includes the use of an Intervention Workover Controls System (IWOCS) that supplies hydraulic power to operate the various functions of the tree. The IWOCS typically includes a hydraulic power unit, pumps, and accumulator banks that provide the hydraulic power as a supply of pressurized hydraulic fluid. This equipment is located topside, and the IWOCS also includes a workover umbilical that transmits the hydraulic fluid, electrical power, and communication signals from the topside to the subsea tree.

The workover umbilical and rig required for the IWOCS increase the cost of that system, and the capital and operational costs can be significant, especially for workovers of deep subsea wells. Further, the IWOCS generally requires significant space on the topside facility.

One alternative to IWOCS is a Remote Workover Control System (RWOCS), which is similar to IWOCS except that some of the equipment necessary for the workover may be located in the water, e.g., attached to a remotely operated vehicle. Such as system typically still requires a significant amount of space on the topside facility, e.g., for providing the umbilical to the subsea equipment for power and/or communication, for equipment associated with the ROV such as a winch and A-frame, and the like.

Thus, there exists a continued need for an improved apparatus and method for providing a controllable supply of fluid, electrical power, and/or communication signals to subsea well equipment, such as for performing workover operations.

SUMMARY OF THE INVENTION

The embodiments of the present invention generally provide an apparatus and method for providing a controllable supply of fluid, and optionally electrical power and/or communication signals, to a subsea well equipment, such as for performing a workover operation, a chemical injection treatment, or a hydrate remediation operation.

According to one embodiment of the present invention, the apparatus includes a reservoir disposed on a seabed for storing a supply of fluid for delivery to the subsea well equipment. A hydraulic power unit is disposed on the seabed and fluidly connected to the reservoir. The hydraulic power unit includes at least one fluid accumulator. A subsea pumping device is fluidly connected to the hydraulic power unit and configured to receive the fluid from the reservoir via the hydraulic power unit, pressurize the fluid, and deliver the pressurized fluid to the accumulator of the hydraulic power unit. The hydraulic power unit is configured to receive the fluid from the reservoir, direct the fluid to the subsea pumping device, receive the pressurized fluid from the subsea pumping device, store the pressurized fluid in the accumulator, and control an output of the pressurized fluid via the control valve from the accumulator to the subsea well equipment.

For example, the reservoir can be configured to provide hydraulic fluid for pressurization in the subsea pumping device and storage in the accumulator of the hydraulic power unit, and the hydraulic power unit can be configured to deliver the pressurized hydraulic fluid to the subsea well equipment, such as a subsea tree, for selective actuation of a plurality of hydraulic valves of the subsea tree in a workover operation. Alternatively, the reservoir can be configured to provide a chemical fluid for the pressurization in the subsea pumping device and storage in the accumulator of the hydraulic power unit, and the hydraulic power unit can be configured to deliver the pressurized chemical fluid to the subsea equipment to chemically treat the well equipment, e.g., for a hydrate remediation treatment.

In some cases, the subsea pumping device includes a high pressure pump and a low pressure pump disposed on a skid, which is configured to be carried by an ROV to a position proximate the hydraulic power unit on the seabed so that the subsea pumping device can be repeatedly fluidly connected to the hydraulic power unit subsea to refill the accumulator with the pressurized fluid. The hydraulic power unit of the apparatus can include multiple accumulators, e.g., a first, low pressure accumulator and a second, high pressure accumulator. The first accumulator can be configured to store the pressurized fluid at a first pressure, and the second accumulator can be configured to store the pressurized fluid at a second pressure that is higher than the first pressure. Thus, the apparatus can be configured to provide the fluid to the subsea equipment at two or more different pressures. Each accumulator of the pressure unit can include a plurality of bottles, and each bottle can have an internal space with at least one gas-filled bladder therein. The bottles can be configured to receive the fluid in the internal space, but outside the bladder, so that the bladder is compressed as the bottle receives the fluid and the bladder expands as the fluid is delivered from the bottle.

An umbilical can be provided for linking the apparatus to a tied-back facility. The umbilical can provide from the tied-back facility a replenishment supply of the fluid to the reservoir and/or power to the subsea pumping device.

A method of one embodiment of the present invention includes storing a supply of fluid in a reservoir on a seabed for delivery to the subsea well equipment. The fluid is delivered from the reservoir and received in a subsea pumping device. The fluid is pumped from the pumping device to an accumulator of a hydraulic power unit that is disposed on the seabed and stored in the accumulator. For example, the fluid from the reservoir can be provided to the hydraulic power unit and delivered from the hydraulic power unit to the pumping device. An output of the pressurized fluid from the hydraulic power unit to the subsea equipment is controlled. For example, the method can include controlling an output of hydraulic fluid to a subsea tree for selective actuation of a plurality of hydraulic valves of the subsea tree in a workover operation. Alternatively, a chemical fluid can be stored in the reservoir, and the method can include delivering the pressurized chemical fluid to the subsea equipment to chemically treat the well equipment and/or the production fluids.

The pumping of the fluid in the pumping device can include receiving the fluid at a high pressure pump and a low pressure pump that are disposed on a skid carried by an ROV. The pumping device, attached to the ROV, can be repeatedly moved to a position proximate the hydraulic power unit on the seabed and fluidly connected to the hydraulic power unit and reservoir subsea to refill the accumulator with the pressurized fluid.

The pressurized fluid can be stored in multiple accumulators of the hydraulic power unit and at different pressures, e.g., at a first pressure in a first, low pressure accumulator and at a second, higher pressure in a second, high pressure accumulator. Controlling the output of the pressurized fluid from the hydraulic power unit to the subsea equipment can include controlling multiple outputs at multiple different pressures. In each accumulator, the pressurized fluid can be stored in a plurality of bottles, each bottle having an internal space with at least one gas-filled bladder therein. Each bottle can receive the fluid in the internal space outside the bladder so that the bladder is compressed as the bottle receives the fluid and the bladder expands as the fluid is delivered from the bottle.

In some cases, a replenishment supply of the fluid to the reservoir and/or power to the subsea pumping device can be provided via an umbilical from a tied-back facility to the apparatus.

BRIEF DESCRIPTION OF THE DRAWINGS

Figure 1:
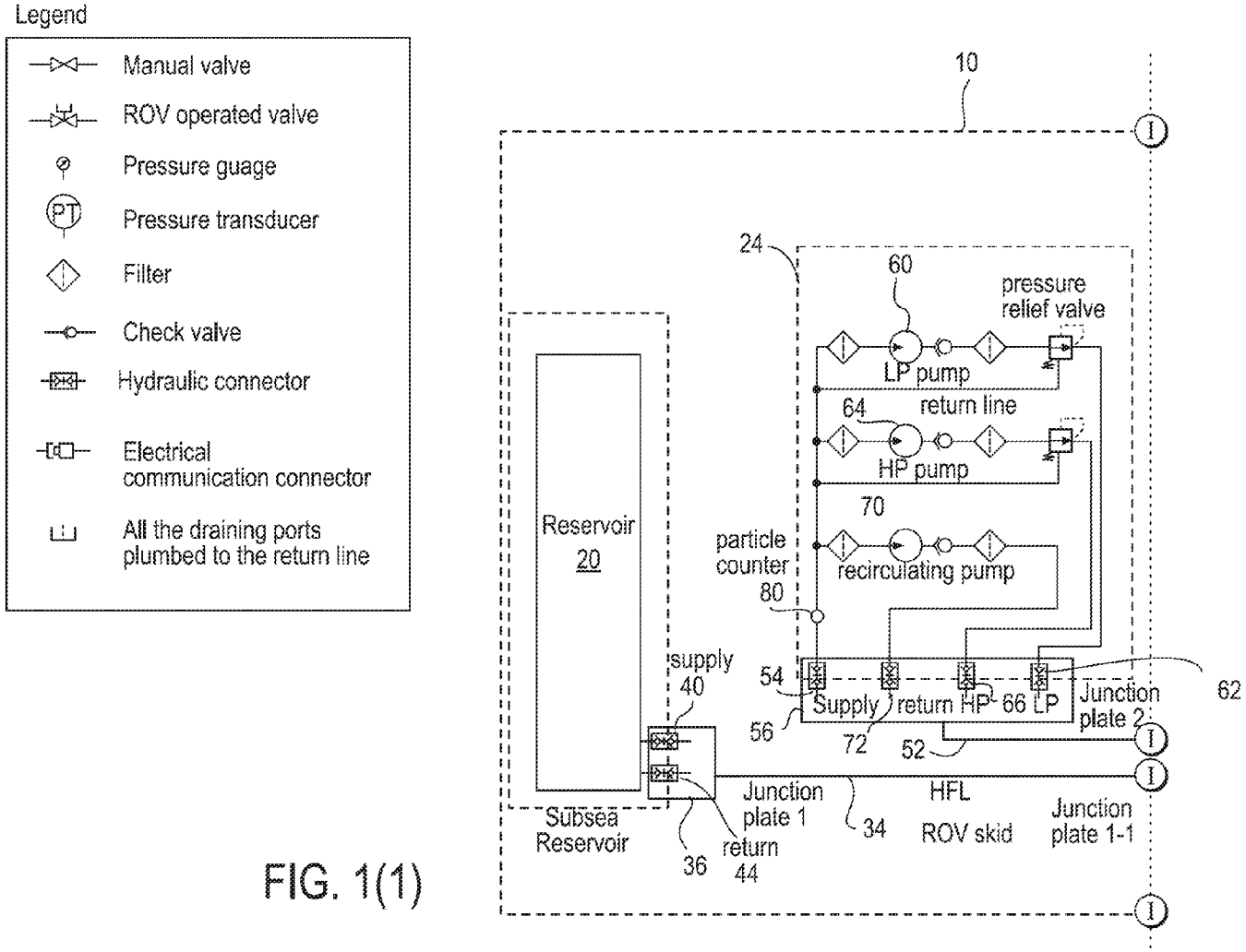
Figure 1:
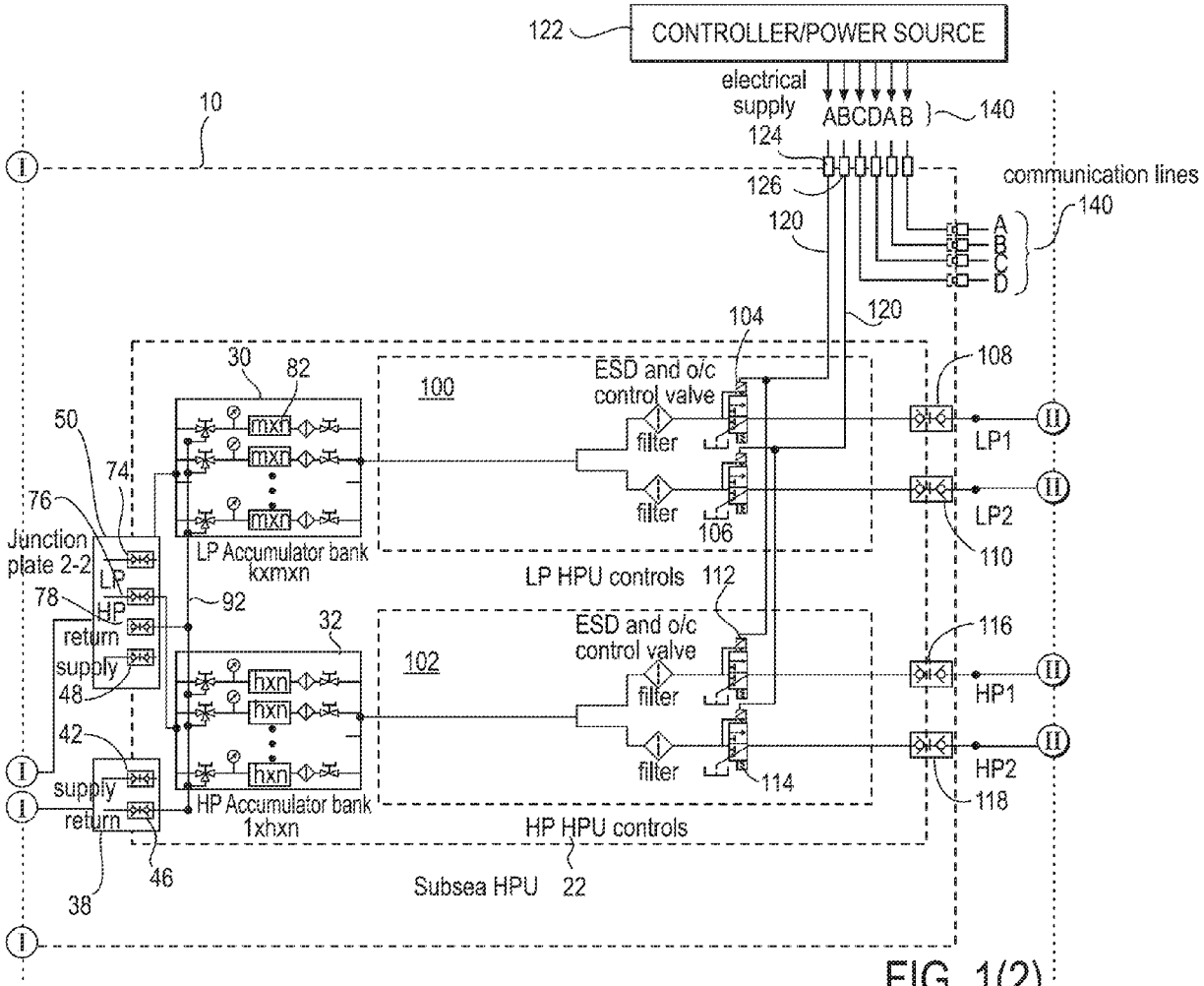
Figure 1:
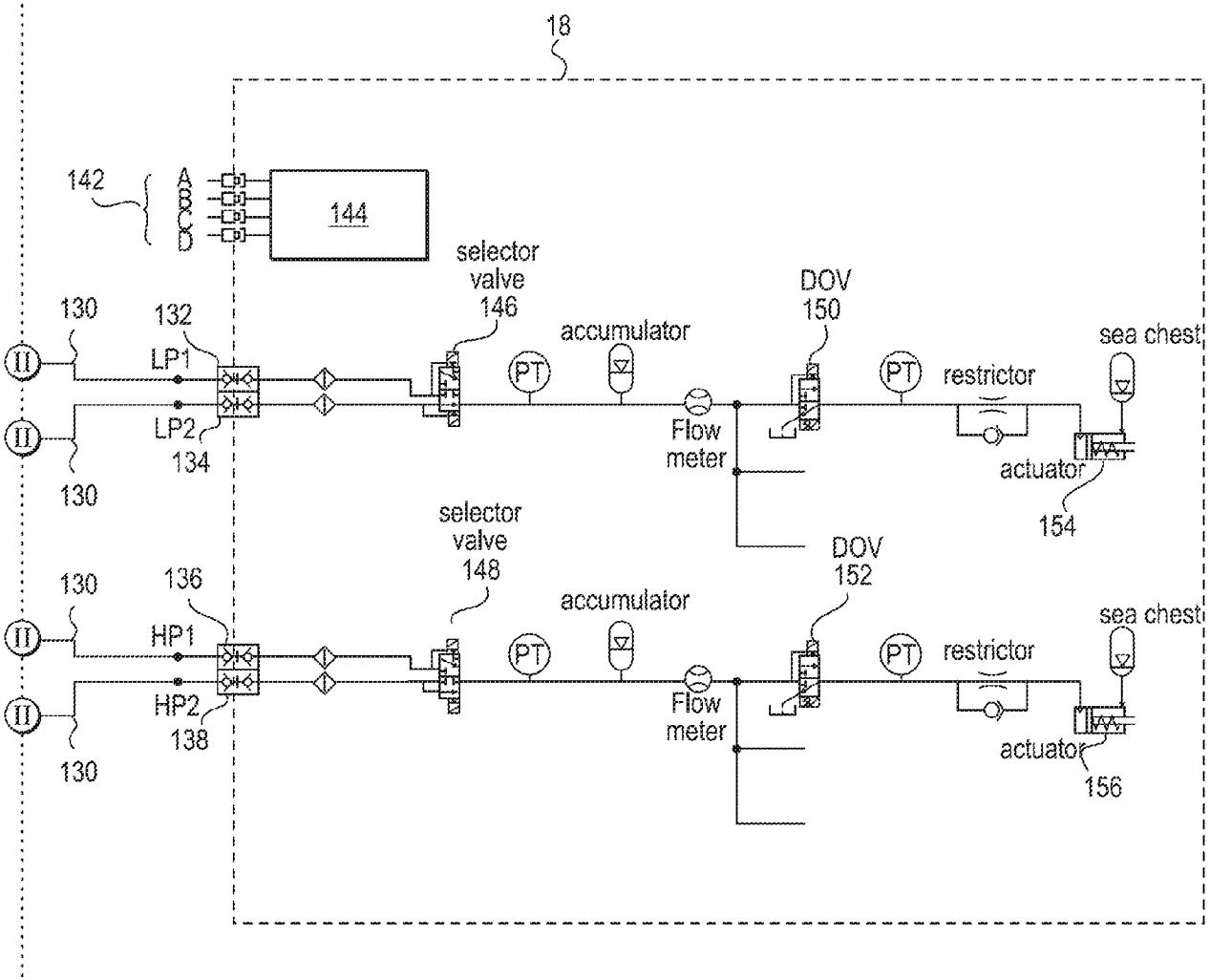
Figure 1A:
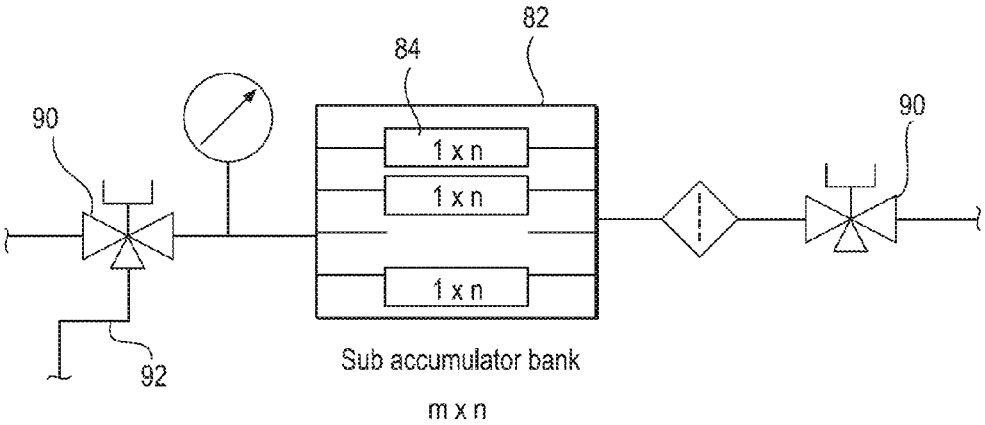
Figure 1B:
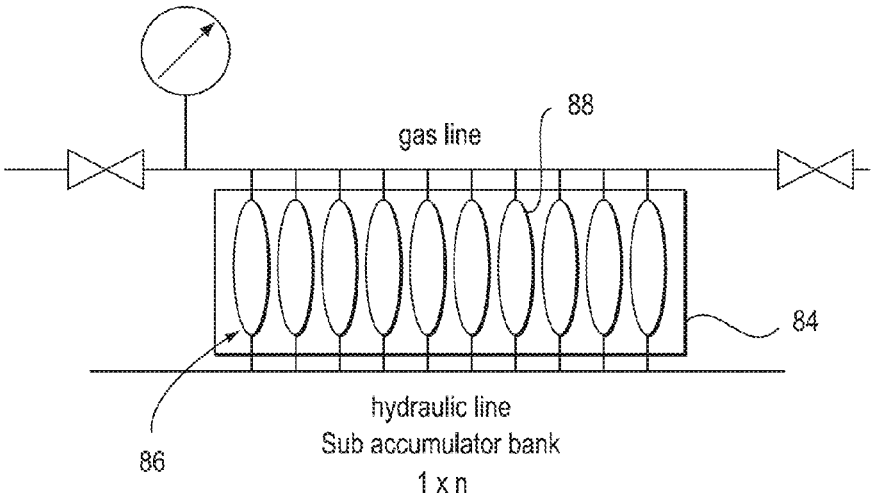
Figure 2:
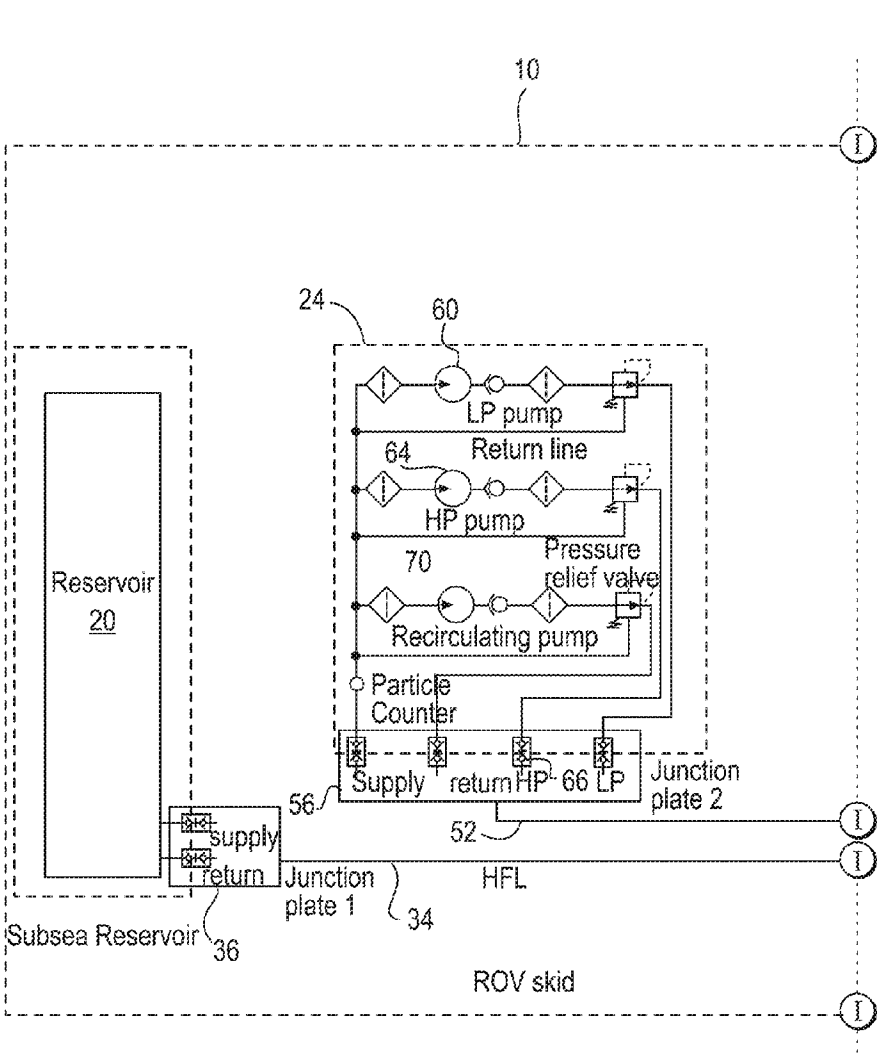
Figure 2:
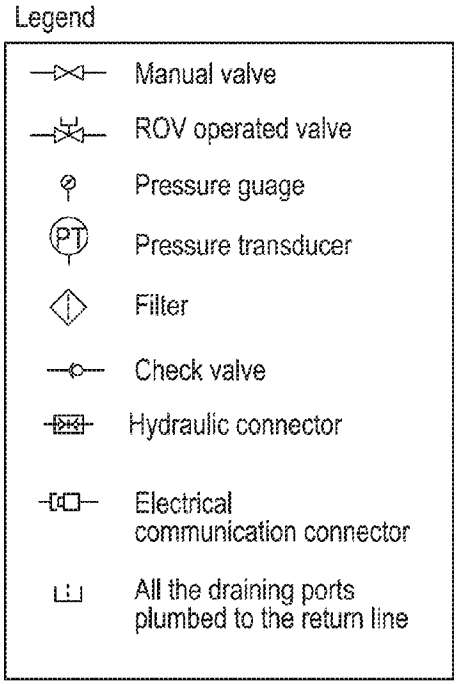
Figure 2:
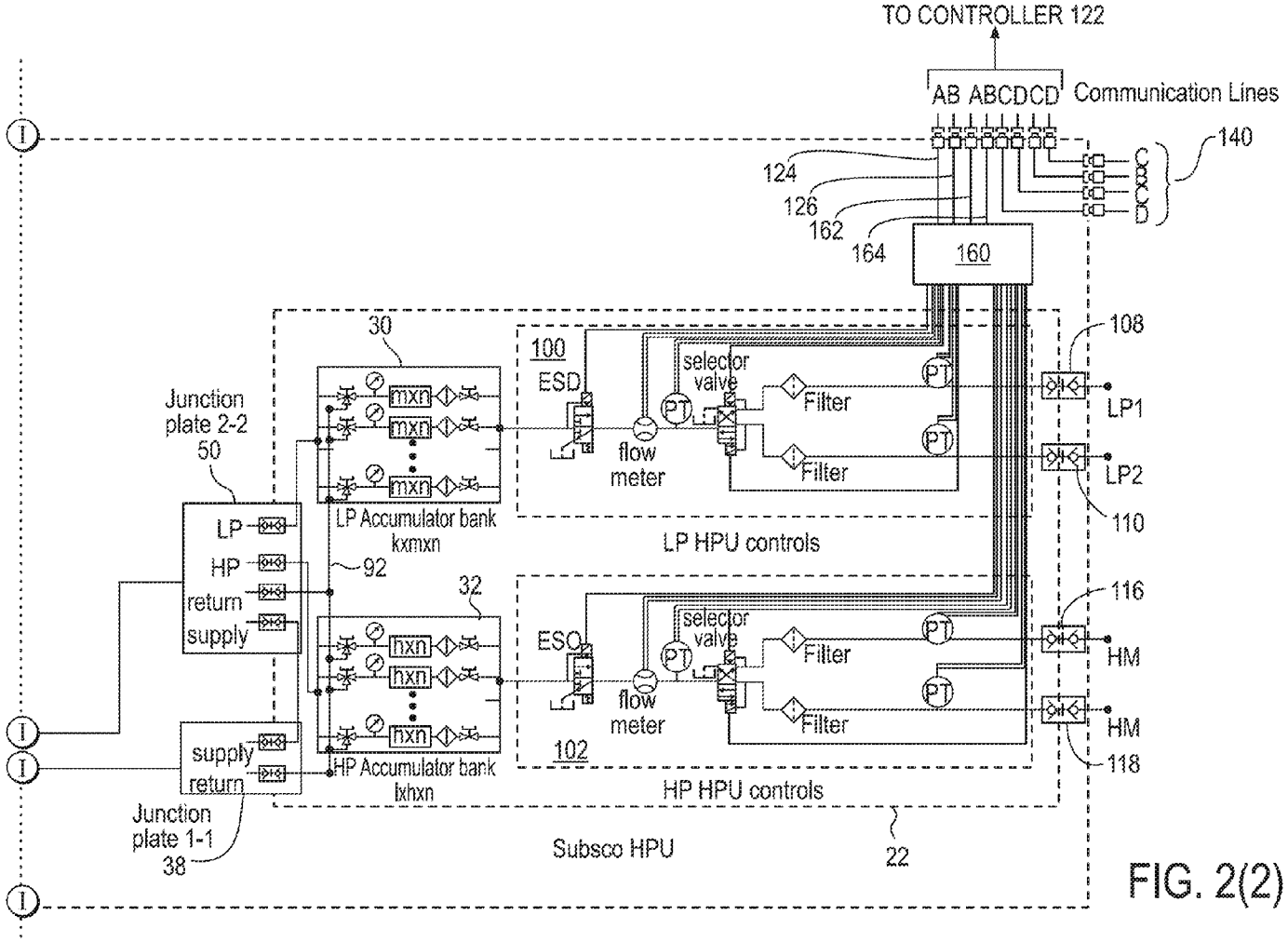
Figure 2:
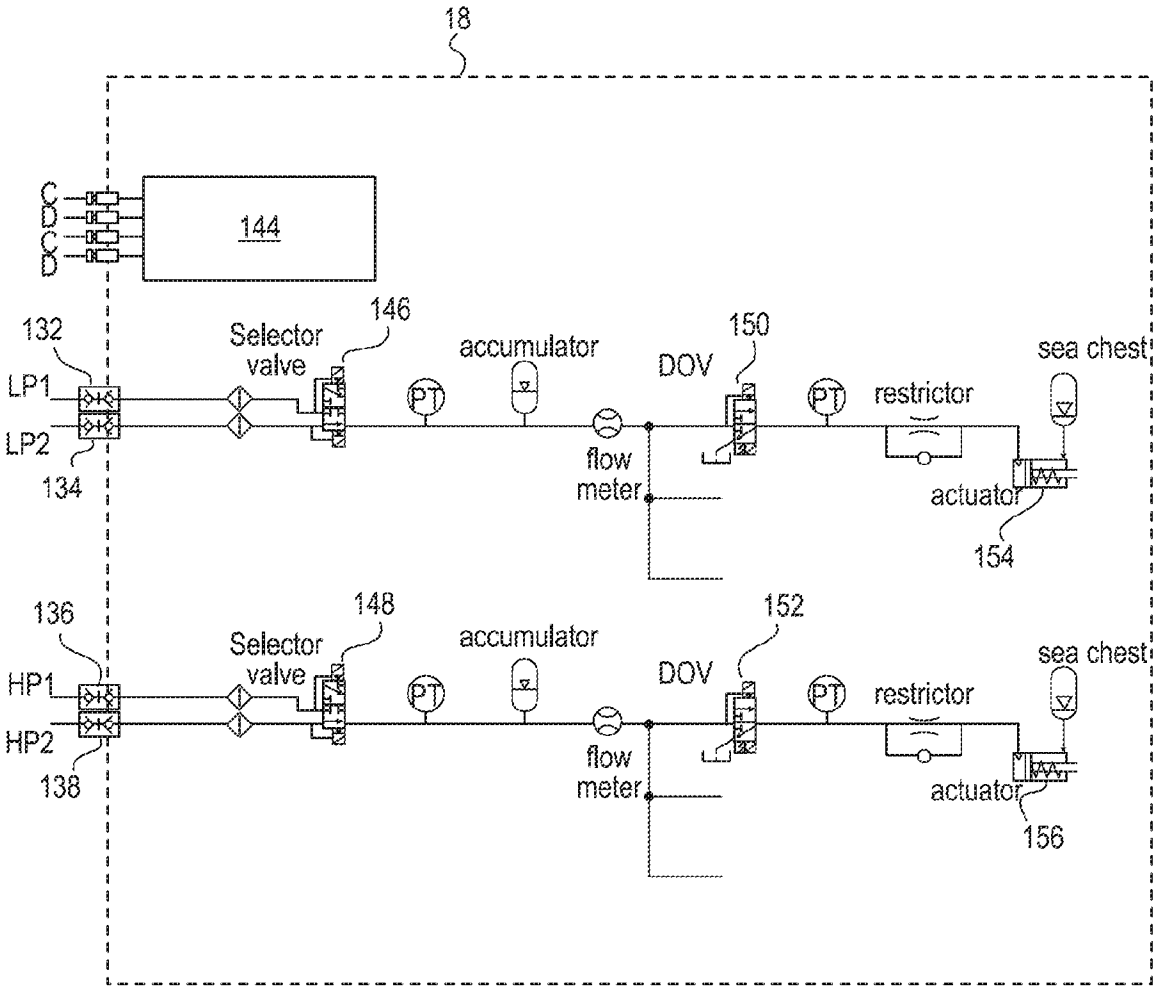
Figure 5:
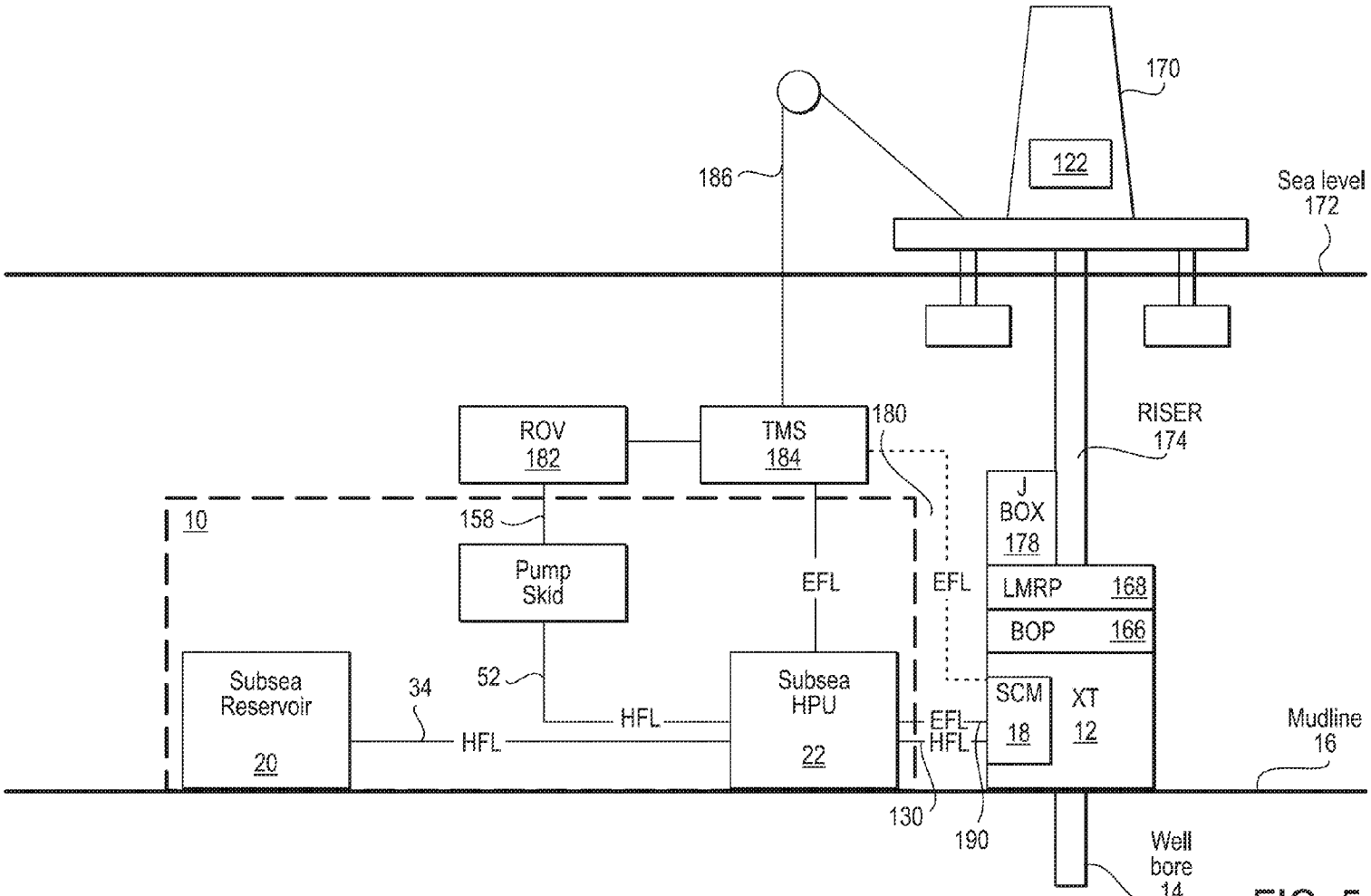
Figure 6:
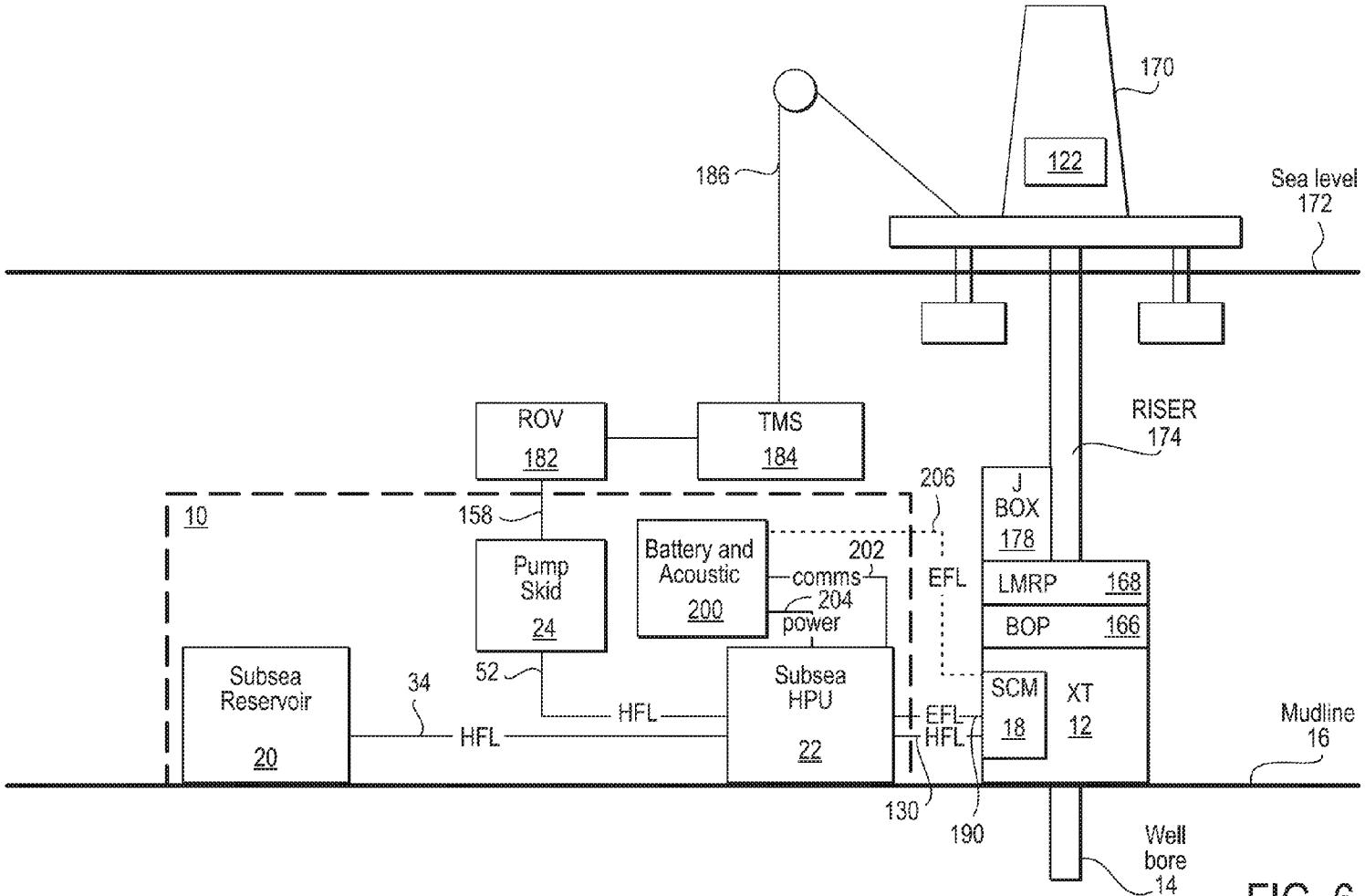
Figure 7:
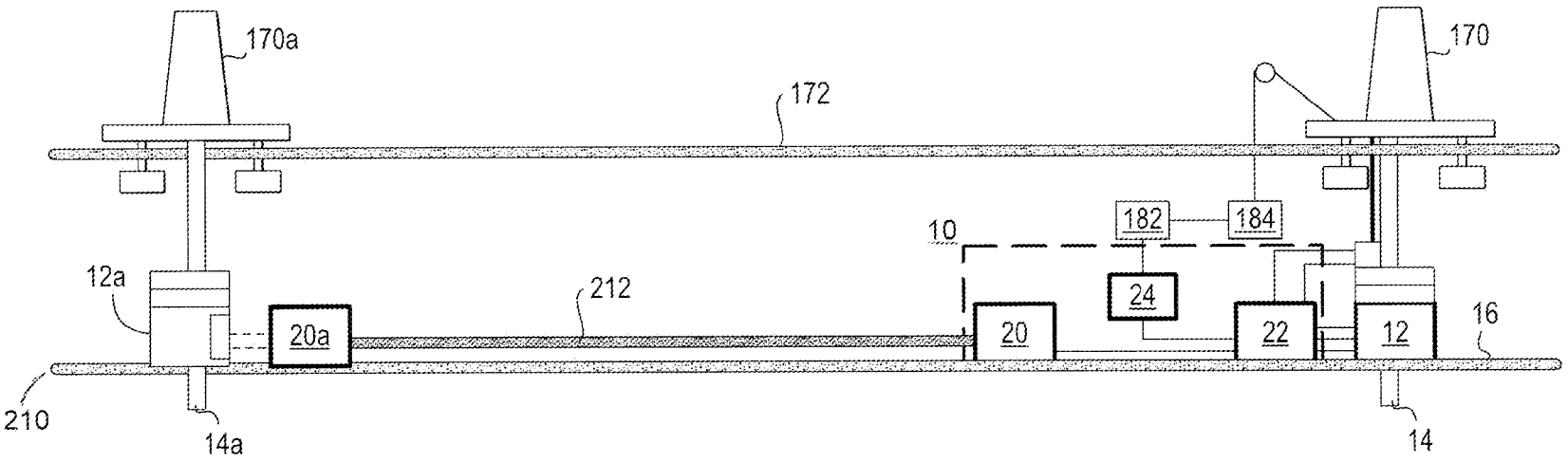

Having thus described the invention in general terms, reference will now be made to the accompanying drawings, which are not necessarily drawn to scale, and wherein:

FIG. 1 is a schematic view illustrating an apparatus for providing a controllable supply of fluid to subsea equipment according to one embodiment of the present invention;

FIG. 1A is a schematic view illustrating a sub-accumulator of the device of FIG. 1;

FIG. 1B is a schematic view illustrating a bottle of the sub-accumulator of the device of FIG. 1A;

FIG. 2 is a schematic view illustrating an apparatus for providing a controllable supply of fluid to subsea equipment according to another embodiment of the present invention;

FIGS. 3-6 are elevation views schematically illustrating systems for providing a controllable supply of fluid to subsea well equipment, each including an apparatus such as the apparatus of FIG. 1 or 2; and FIG. 7 is an elevation view schematically illustrating an umbilical for connecting the apparatus to a subsea component of another subsea facility.

DETAILED DESCRIPTION OF THE INVENTION

The present invention now will be described more fully hereinafter with reference to the accompanying drawings, in which some, but not all embodiments of the invention are shown. Indeed, this invention may be embodied in many different forms and should not be construed as limited to the embodiments set forth herein; rather, these embodiments are provided so that this disclosure will satisfy applicable legal requirements. Like numbers refer to like elements throughout.

Referring now to the drawings and, in particular, to FIG. 1, there is shown an apparatus 10 for providing a controllable supply of fluid to subsea equipment 12 (FIGS. 3-7), including a subsea control module ("SCM") 18 according to one embodiment of the present invention. For example, the apparatus 10 can be connected to a subsea production control system and can provide a supply of hydraulic fluid to the SCM 18, which can control a variety of types of subsea equipment. In particular, the apparatus 10 can provide fluid to, and/or operate, a subsea Christmas tree or other subsea well equipment 12 associated with the operation of a subsea well 14 (FIGS. 3-7) for the production of hydrocarbons, such as for controlling the operations of the tree 12 during a workover operation to ensure proper function of the tree 12. Alternatively, the apparatus 10 can provide fluids to other types of subsea equipment, including a well head, associated controls or manifolds, a pipeline end terminal, or the like. Conventional hydraulic fluids include mineral- or water-based liquids, including fluids provided by desalinating seawater. Alternatively, the apparatus 10 can be used for supplying other fluids to the well 14, e.g., to provide chemicals to the well 14. The various components of the apparatus 10 can be located subsea (i.e., underwater) and, in some cases, some or all of the components are disposed on the seabed 16 (i.e., in close proximity to the seafloor, for example, by resting directly on the seafloor or on a foundation or equipment that, in turn, rests on the seafloor).

As illustrated in FIG. 1, the apparatus 10 generally includes a reservoir ("Subsea reservoir") 20, a hydraulic power unit ("Subsea HPU") 22, and a subsea pumping device ("ROV skid") 24. The reservoir 20 is a subsea device and typically is disposed on the seabed 16. The reservoir 20 can be a tank or other fluid storage device that is configured to supply the fluid for delivery to the subsea equipment 12. The size of the reservoir 20 can be designed according to the fluid needs of the well 14 for the particular type of operation that is planned. The reservoir 20 typically stores the fluid at a pressure below the pressure which is required for the operation of the equipment 12. For example, the fluid can be stored in the reservoir 20 at a pressure that is about equal to the ambient pressure of the water at the subsea location of the reservoir 20. The reservoir 20 can be located close to the well 14 and equipment 12, though it is appreciated that the reservoir 20 may be used to supply fluid to more than one apparatus 10 and/or well 14, and in some cases the reservoir 20 may be located some distance from the well 14 and/or equipment 12. In either case, the reservoir 20 can be configured to be refilled, e.g., by delivery of additional fluids to the subsea location via a pipeline from a surface refilling device, delivery via a pipeline from a subsea fluid source, discrete deliveries of additional fluid from a refill vessel that is transported to the subsea location of the reservoir 20, transporting the reservoir 20 to the surface for refilling, or the like.

The reservoir 20 is fluidly connected to the hydraulic power unit 22 and configured to provide the fluid to the hydraulic power unit 22. In the embodiment of FIG. 1, the hydraulic power unit 22 is disposed on the seabed 16 (illustrated in FIG. 3). The various connections between the hydraulic power unit 22, the reservoir 20, and each of the components of the apparatus 10 can be provided by tubular lines, such as pipes, hoses, and the like. In some cases, such subsea hydraulic connections are provided by tubular lines called hydraulic flying leads (HFLs), conventional jumper devices that can incorporate one or more lines with connectors at both ends and which can be wrapped with an outer layer or otherwise protected. It is also appreciated that control valves, check valves, filters, meters, and other conventional devices can be included in and between the various components of the apparatus 10.

The hydraulic power unit 22 includes one or more fluid accumulators ("LP Accumulator bank" and "HP Accumulator bank") 30, 32 that are configured to store pressurized fluid that can be delivered to the equipment 12, e.g., for operation of the equipment 12 during a workover. As illustrated in FIG. 1, the connection between the hydraulic power unit 22 and the reservoir 20 can be effected by tubular line 34 that extends between a junction plate 36 at the reservoir 20 and a junction plate 38 at the hydraulic power unit 22. This is for supply and return of non-pressurized hydraulic fluid. Each junction plate 36, 38 can include hydraulic connectors for engaging the end of the HFL or other tubular lines 34. In particular, a supply connector 40 at the junction plate 36 of the reservoir 20 can be connected to the corresponding supply connector 42 at the junction plate 38 of the hydraulic power unit 22, and a return connector 44 at the junction plate 36 of the reservoir 20 can be separately connected to the corresponding return connector 46 at the junction plate 38 of the hydraulic power unit 22.

At the hydraulic power unit 22, fluid received from the reservoir 20 via the supply connector 46 is directed to a supply connector 48 on another junction plate 50 and via a tubular line 52 from junction plate 50 to a supply connector 54 on a junction plate 56 of the pumping device 24. Thus, the hydraulic power unit 22 is fluidly connected to the subsea pumping device 24, which is configured to receive the fluid from the reservoir 20 via the hydraulic power unit 22, pressurize the fluid, and deliver the pressurized fluid to the accumulator(s) 30, 32 of the hydraulic power unit 22. As illustrated, the pumping device 24 can include multiple pumps for charging the fluid to different pressures. In particular, a low pressure pump 60 receives the fluid via the supply connector 54 on the junction plate 56 and pumps the fluid at a first pressure to a low pressure output connector 62 on the junction plate 56. Similarly, a high pressure pump 64 receives the fluid via the supply connector 54 on the junction plate 56 and pumps the fluid at a second, higher pressure to a high pressure output connector 66 on the junction plate 56. A recirculation pump 70 also receives the fluid via the supply connector 54 on the junction plate 56 and circulates the fluid to a return output connector 72 on the junction plate 56. The low pressure output connector 62, high pressure output connector 66, and return output connector 72 on the junction plate 56 are connected to a respective low pressure input connector 74, high pressure input connector 76, and return connector 78 on the junction plate 50 of the hydraulic power unit 22.

In the illustrated embodiment, the pumping device 24 is connected to the hydraulic power unit 22 and configured to receive the fluid from the reservoir 20 indirectly, i.e., via the hydraulic power unit 22. The pumping device 24 does not need to be connected directly to the reservoir 20, and, in some cases, the pumping device 24 can have a single junction plate or other connection feature to simplify the connection and disconnection of the pumping device 24 from the rest of the apparatus 10. It is appreciated that, in other embodiments, the pumping device 24 can be alternatively connected, e.g., by a direct link between the pumping device 24 and the reservoir 20 for receiving the fluid from the reservoir 20 and another link between the pumping device 24 and the hydraulic power unit 22 for providing the pumped fluid from the pumping device 24 to the hydraulic power unit 22. In any case, the pumping device 24 can be configured to be separated from the rest of the apparatus 10, e.g., so that the hydraulic power unit 22 can be configured to provide pressurized fluid to the well equipment 12 even while the pumping device 24 has been disconnected from the hydraulic power unit 22 and removed from the vicinity of the hydraulic power unit 22.

The pumping device 24 can also include a particle counter 80 for detecting particles in the fluid. The cleanliness of the fluid can be determined according to the detection of particles in the fluid. The cleanliness determination can be made by a controller that is located within the pumping device 24, elsewhere within the apparatus 10, or remote from the apparatus 10, e.g., at the topside location. In any case, if the fluid is determined to contain more than a predetermined number of particles or to have less than a desired cleanliness (e.g., a level of greater than NAS 6), the pumping device 24 can recirculate the fluid through the recirculation pump 70 and back to the reservoir 20 until a desired cleanliness is achieved, and/or valves in the hydraulic power unit 22 upstream of the accumulators 30, 32 can be closed to force the fluid to recirculate to the reservoir 20 until the desired cleanliness is achieved. Filters or other cleaning devices can be provided within the reservoir 20 or elsewhere in the apparatus 10. The pumping device 24 can also include check valves, pressure relief valves, and the like for controlling the flow of the fluid.

The hydraulic power unit 22 can be configured to store and provide fluid at multiple different pressures. For example, as illustrated, the fluid received through the low and high pressure input connectors 74, 76 are directed separately to the low pressure accumulator 30 and the high pressure accumulator 32. Each accumulator 30, 32 can include a plurality or bank of sub-accumulators 82 connected in a parallel configuration. In one embodiment, illustrated in FIG. 1A, each sub-accumulator 82 includes a plurality or bank of bottles 84. Any number of the bottles 84 can be provided, e.g., depending on the capacity of pressurized fluid that is desired to be stored therein.

Each bottle 84 can be a conventional rigid pressure vessel that defines an internal space 86. As indicated in FIG. 1B, one or more gas-filled bladders 88 can be disposed within the internal space 86 of the bottle 84, and the bottle 84 can be configured to receive the fluid into the internal space 86 outside the bladder 88 so that the fluid surrounds the bladder 88. The bladder 88, which can be formed of a deformable and/or elastomeric material, such as polyurethane and fiberglass, is compressed as the bottle 84 receives the fluid, and the bladder 88 expands as the fluid is delivered from the bottle 84. In this way, the compressible gas within the bladders 88 can be pressurized and provide the stored energy for delivering the fluid at desired pressures. In other embodiments, other types of accumulators can be used. For example, each accumulator can include one or more bottles, each bottle including a spring-loaded and/or piston-type energy storage mechanism.

Each accumulator 30, 32 or sub-accumulator 82 can also include valves, pressure gauges, and the like for monitoring and controlling the operation of the bottles 84, sub-accumulators 82, and accumulators 30, 32. In particular, each sub-accumulator 82 (or bottle 84) can be provided between ROV-operated valves 90 so that an ROV can close the valves and isolate a particular sub-accumulator 82 (or bottle 84) from operation if the sub-accumulator 82 (or bottle 84) malfunctions or otherwise requires maintenance, repair, or replacement. For example, if the pressure detected in a particular bottle 84 (inside or outside the bladder(s) 88) varies from the pressure in the other bottles 84 of the same sub-accumulator 82 or accumulator 30, 32, it may be determined that one of the bladders 88 in the bottle 84 has ruptured or the bottle 84 is otherwise malfunctioning. In that case, it may be desired to isolate the bottle 84 from the rest of the sub-accumulator 82 or accumulator 30, 32, remove the bottle 84, and replace it with a different bottle 84. In some cases, an entire sub-accumulator 82 or accumulator 30, 32 can be changed at the same time. Fluid delivered to a bottle 84 that has been removed from operation may be diverted to the other bottles 84 of the same sub-accumulator 82 or accumulator 30, 32, or the fluid may be returned via a return connection 92, to the reservoir 20.

Each accumulator 30, 32 provides a pressurized fluid output that can be selectively opened and closed to deliver the fluid from the apparatus 10 and thereby control an output of the pressurized fluid from the accumulator 30, 32 to the subsea equipment 12. As shown in FIG. 1, a low pressure control ("LP HPU controls") 100 and high pressure control ("HP HPU controls") 102 can each be provided with two redundant output lines, each of which is separately controlled. For example, the fluid from the low pressure accumulator 30 is provided via first and second low-pressure directional control valves 104, 106 that are used for the emergency shut-down and flow line selection, to low pressure output connectors ("LP1" and "LP2") 108, 110. The separate, parallel lines to connectors 108, 110 are typically used alternately, such that one line is redundant, whenever the other is operational. Similarly, the fluid from the high pressure accumulator 32 is provided via first and second high-pressure directional control valves 112, 114 that are used for the emergency shut-down and flow line selection, to high pressure output connectors ("HP1" and "HP2") 116, 118. The separate, parallel lines co connectors 116, 118 are typically used alternately, such that one line is redundant, whenever the other is operational. Each directional control valve 104, 106, 112, 114, can be actuated by an electrical signal communicated via electrical supply lines 120 from a controller 122. More particularly, the controller 122, which can be located at the topside facility or another location, can provide power to either of two electrical supply ports 124, 126 to selectively open the first low and high pressure output connectors 108, 116 or the second low and high pressure output connectors 110, 118.

The output connectors 108, 116, 110, 118 can be connected to corresponding inputs of the equipment 12 so that the pressurized fluid is provided to the equipment 12 for selectively powering the equipment 12. For example, tubular lines 130 can connect each of the low and high pressure output connectors 108, 116, 110, 118 to the corresponding low pressure input connectors 132, 134 and high pressure input connectors 136, 138 of the equipment 12. Electrical connections can also extend from pass-through ports 140 of the apparatus 10 so that electrical power and/or communications delivered to the apparatus 10 are provided to the equipment 12, e.g., to corresponding inputs 142 of a subsea electronics module ("SEM") 144 of the equipment 12. In the illustrated embodiment, the equipment 12 includes two redundant input ports 132, 134 for low pressure and two redundant input ports 136, 138 for high pressure, and the apparatus 10 can provide fluid selectively and separately to each of the ports 132, 134, 136, 138. The illustrated equipment 12 is a subsea tree configured to direct the fluid through low and high pressure selector valves 146, 148 to corresponding directional control valves ("DCV") 150, 152 and subsea actuators 154, 156 for controlling operations of the tree 12. It is appreciated that the apparatus 10 can alternatively provide fluid to other types of subsea equipment 12.

While the illustrated embodiment includes two pumps 60, 64 and two accumulators 30, 32, other numbers of pumps and/or accumulators can be used in other embodiments. More particularly, the apparatus 10 can be configured to provide fluid at any number of different pressures, and each pump and accumulator can provide one or more of the different pressures. For example, the low pressure pump 60 and accumulator 30 can be configured to deliver the fluid at a pressure of about 5000 psi, and the high pressure pump 64 and accumulator 32 can be configured to deliver the fluid at a higher pressure of about 10,000 psi, e.g., so that the apparatus 10 can provide fluid for separately operating valves of the equipment 12 that are rated for 5000 psi and 10,000 psi respectively. Also, it is appreciated that the fluid delivered by the apparatus 10 to the well equipment 12 can be a relatively incompressible fluid, and the energy required for providing the fluid at elevated pressures can be stored in the compressible gas contained in the bladders 88 of the accumulators 30, 32.

In some cases, the subsea pumping device 24 is located on an ROV skid, i.e., a frame 158 connected to the ROV so that the ROV carries the skid as the ROV moves (see FIG. 3), e.g., between the location of the apparatus 10 and the topside facility. The ROV can make successive trips between the topside facility and the subsea location of the hydraulic power unit 22 and can carry the ROV skid and the subsea pumping device 24 with it. In other cases, the subsea pumping device 24 can be a subsea resident device that is disposed on the seabed 16, e.g., in proximity and/or connected to the reservoir 20 and/or the hydraulic power unit 22. In either case, the subsea pumping device 24 can be configured to be powered by the ROV. In other words, the energy required for actuating the one or more pumps of the pumping device 24 can be provided by the ROV, e.g., by an electrical, hydraulic, or mechanical connection between the ROV and the pumping device 24. The ROV, in turn, can be powered via a tether to the topside facility or an internal power storage device.

The pumping device 24 can be removed from the proximity of the hydraulic power unit 22, e.g., when the ROV returns to the surface in the case of the pumping device 24 being provided on the ROV skid, and the hydraulic power unit 22 can continue to operate when the pumping device 24 is not connected thereto. Depending on the capacity of the hydraulic power unit 22, the hydraulic power unit 22 may be able to operate the equipment 12 for an extended period of time without interim connection to the pumping device 24. In some cases, the accumulators 30, 32 can be sized and configured to store enough fluid as sufficient pressure to operate the equipment 12 for a week or more. For example, each accumulator 30, 32 can be adapted to provide over 100 gallons of usable fluid at depths of 10,000 feet or more, so that the hydraulic power unit 22 can operate (i.e., open and close) each valve on a subsea tree three times daily for at least one week. If the pumping device 24 is carried by the ROV, the pumping device 24 can be connected to the hydraulic power unit 22 each time the ROV is deployed to the seabed 16 if the hydraulic power unit 22 requires recharging. Thus, while the ROV is deployed for other operations, the ROV can also provide energy to the apparatus 10 as required for charging the hydraulic power unit 22 and operating the equipment 12.

In some cases, the apparatus 10 can be configured to provide communication to the various components of the subsea hydraulic power unit 22. For example, as illustrated in FIG. 2, the apparatus 10 includes a control pod 160 with the subsea hydraulic power unit 22. The control pod 160 is connected via the electrical supply ports 124, 126 and communication lines 162, 164 to the controller 122. The control pod 160 is configured to distribute power to the various components of the hydraulic power unit 22 and coordinate the communication of signals between the controller 122 and the components of the control unit 22.

Figure 3:
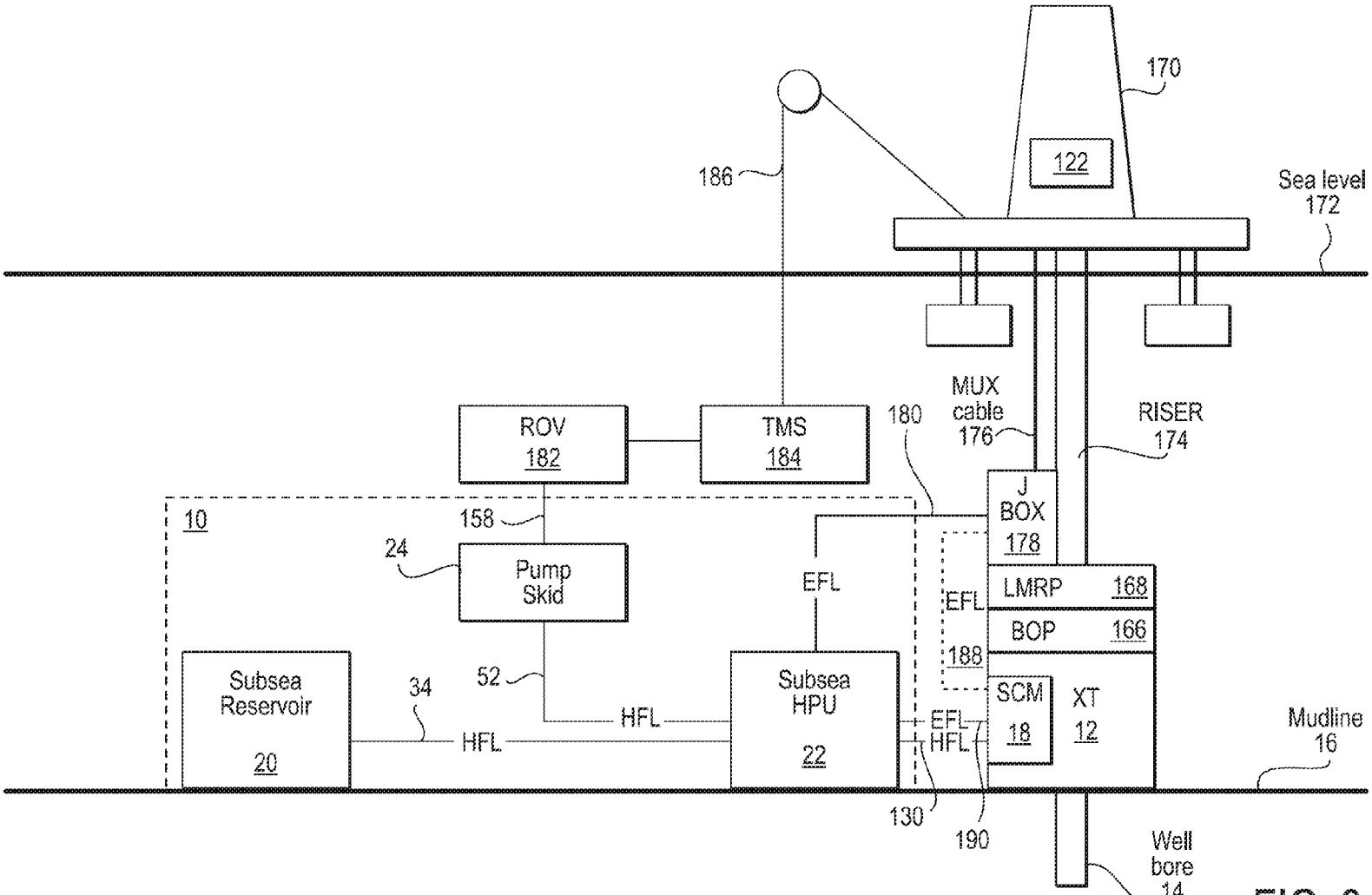

It is appreciated that the electrical power and/or communication to the apparatus 10 can be provided in a number of different ways. In some cases, electrical power and communication can be provided to the apparatus 10 from a topside facility. For example, as shown in FIG. 3, the apparatus 10 is configured to provide fluid to a supply of hydraulic fluid to a subsea tree ("XT") 12 with an associated blow out preventer ("BOP") 166 and lower marine riser package ("LMRP") 168. The tree 12 is connected to the wellbore of the subsea well (collectively, 14) and controls a flow of fluid between the well 14 and a topside facility 170 at the water surface 172 that is connected to the tree 12 and wellbore 14 via a riser 174. A blow out preventer mux line ("MUX cable") 176 extends between the topside facility 170 and the blow out preventer 166 and provides a medium for transmitting power, communication, and/or telemetry therebetween. The blow out preventer mux line 176 can be connected to the blow out preventer 166 by a junction box ("J box") 178 provided on the lower marine riser package 168, and the junction box 178 can also provide a connection from the blow out preventer mux line 176 to the apparatus 10. In particular, an electrical flying lead ("EFL") or other electrical connector 180 can connect the subsea hydraulic power unit 22 of the apparatus 10 to the blow out preventer mux line 176 at the junction box 178 so that the hydraulic power unit 22 can receive electrical power from the topside facility 170 via the mux line 176, junction box 178, and electrical flying lead 180. The subsea hydraulic power unit 22 can receive fluid from the reservoir 20 and pumping device 24, and the pumping device 24 can be carried by, and powered by, an ROV 182 that is connected to the topside facility 170 via a tether management system ("TMS") 184 and appropriate tether(s) or umbilical(s) 186. The operation of the apparatus 10 can be managed by communication from the controller 122 at the topside facility 170 via the connection provided through the mux line 176 and electrical flying lead 180. The fluid output from the hydraulic power unit 22 can be provided to the tree 12. The subsea control module 18 of the tree 12 can receive electrical power and/or communication from the mux line 176 via an electrical flying lead 188 connected to the mux line 176 at the junction box 178, or via an electrical flying lead 190 connected between the subsea electronics module 144 and the hydraulic power unit 22, e.g., connected to the ports 140 of the apparatus 10.

Figure 4:
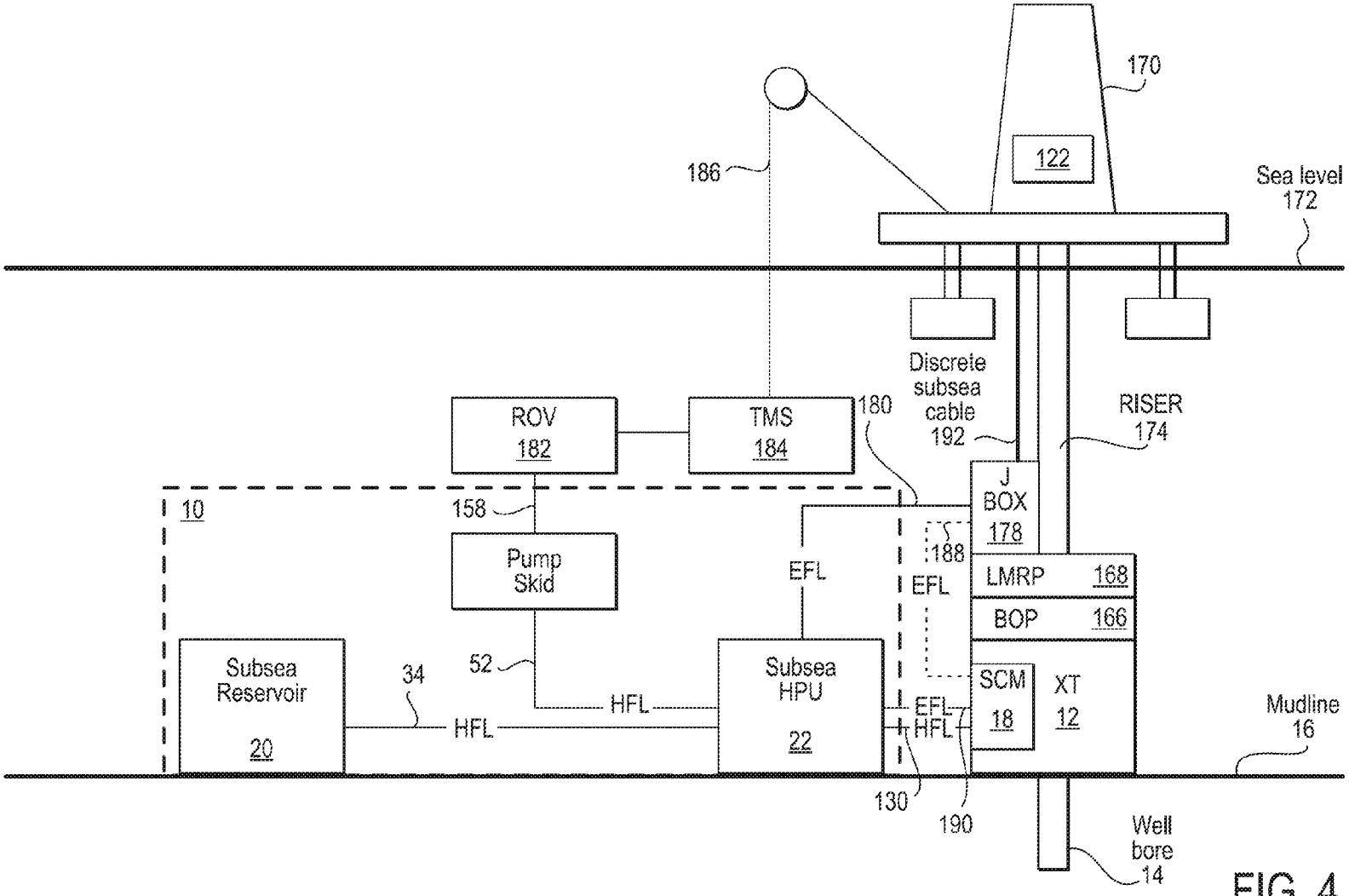

In other embodiments, another cable can be used in place of the mux line 176. For example, as shown in FIG. 4, a discrete subsea cable 192 can connect the topside facility 170 to the junction box 178 so that the topside facility 170 can provide power and/or communication to the apparatus 10 via the cable 192, junction box 178, and the electrical flying lead 180 connecting the junction box 178 to the subsea hydraulic power unit 22.

In other embodiments, the umbilical or tethers 186 that connect the ROV to the topside facility 170 can also be used for transmitting power and/or communications from the topside facility 170 to the apparatus 10. For example, as shown in FIG. 5, an electrical flying lead or other connector 194 can extend from the tether management system 184 and/or the ROV 182 to the subsea hydraulic power unit 22 so that operation of the apparatus 10 can be managed by communication from the controller 122 at the topside facility 170 via the connection provided through the tether 186 and the electrical flying lead 194. The subsea control module 18 of the tree 12 can receive electrical power and/or communication from the tether management system 184 via an electrical flying lead 196 between the tether management system 184 and the subsea electronics module 144, or via an electrical flying lead 190 connected between the subsea electronics module 144 and the hydraulic power unit 22, e.g., connected to the ports 140 of the apparatus 10.

As shown in FIG. 6, the apparatus 10 can receive electrical power and/or communications from a battery and acoustic signal box 200, which can be located on top of the lower marine riser package 168. One or more electrical flying leads or other connectors 202, 204 can extend from the box 200 to the subsea hydraulic power unit 22 so that the apparatus 10 can be powered and controlled by communication from the controller 122 at the topside facility 170 via the box 200 and the electrical flying lead(s) 202, 204. The subsea control module 18 of the tree 12 can receive electrical power and/or communication from the box 200 via an electrical flying lead 206 between the box 200 and the subsea electronics module 144, or via an electrical flying lead 190 connected between the subsea electronics module 144 and the hydraulic power unit 22, e.g., connected to the ports 140 of the apparatus 10. It is appreciated that the embodiments of FIGS. 5 and 6 can be deployed from a multi-service vessel or a rig.

Various types of fluids can be provided to the subsea equipment 12 by the apparatus 10. As described above, the fluid can be a hydraulic fluid for operating valves or other hydraulically actuated devices of the equipment 12. Alternatively, the apparatus 10 can be used to supply chemicals to the well 14 as preventive measure against the deposition of scale, asphaltene, wax, hydrate, and the like. For example, the reservoir 20 can be configured to provide chemical fluids that act as preventive measures against the deposition of scale, asphaltene, wax, hydrate, and the like, throughout the well 14 and the tubings, valves, pumps, or other equipment through which the production fluids flow from the well 14. The chemical fluid can be provided from the reservoir 20 for pressurization in the subsea pumping device 24 and storage in the accumulator 30, 32 of the hydraulic power unit 22, as described above. Thus, the hydraulic power unit 22 can be configured to deliver the pressurized chemical fluid to the subsea equipment 12 to chemically treat the well equipment 12 and/or the production fluids that are produced from the well 14.

The apparatus 10 can also be used to perform an in-situ hydrate remediation of the equipment 12, such as is required for some hydrate-affected subsea trees, manifolds, and jumpers. Such a hydrate remediation operation can be performed by injecting methanol or other fluid substances upstream of a clogged section of the equipment 12. In some cases, the pumping device 24 can also be used to create a vacuum in the equipment 12, upstream and/or downstream of the clogged equipment 12, before or during the methanol injection. Any fluid removed from the equipment 12 during such an operation can be delivered with the produced fluids through the riser 174 to the topside facility 170, or the fluids can be re-injected into the well 14.

As illustrated in FIG. 7, the apparatus 10 can be fluidly and/or electrically connected to a subsea component of another, tied-back facility 210. The tied-back facility 210 can include one or more subsea wells **14*a*, topside facilities 170*a*, and/or subsea equipment 12*a*. The link 212 between the tied-back facility 210 and the apparatus 10 can be an umbilical configured to supply power (electrical or hydraulic) to the apparatus 10, control signals, and/or fluids or one or more types. For example, if the pumping device 24 is a seabed-resident component of the apparatus 10, the umbilical 212 can provide electrical and/or hydraulic power from the tied-back facility 210 to the pumping device 24 for operation and/or control of the pumping device 24. In addition, or alternative, the tied-back facility 210 can provide a flow of fluid to refill the reservoir 20, e.g., a flow of hydraulic control fluid or chemical for a chemical injection operation. It is appreciated that the type of fluid could be modified over time according to the operational needs of the subsea equipment 12. The fluid, power, or signals can be provided from a subsea device 20*a* at the tied-back facility 210 that includes a reservoir, electrical power supply, controller, or the like. It is appreciated that the umbilical or other link 212 may be of a size than would otherwise be required if the tied-back facility 210 were to provide the chemicals as the chemicals are needed for the chemical injection or other operation. That is, since the chemicals can be provided before the chemical injection operation begins, the chemicals can be delivered to the reservoir 20 at a low rate, i.e., lower than the subsequent rate of delivery from the apparatus 10 to the equipment 12, such that a relatively capacity umbilical 212 can slowly refill the reservoir 20**.

Many modifications and other embodiments of the inventions set forth herein will come to mind to one skilled in the art to which these inventions pertain having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. An apparatus for providing a controllable supply of fluid to a subsea well equipment, the apparatus comprising:

a reservoir disposed on a seabed for storing a supply of fluid for delivery to the subsea well equipment;

a hydraulic power unit disposed on the seabed and fluidly connected to the reservoir, the hydraulic power unit including at least one fluid accumulator; and a subsea pumping device fluidly connected to the hydraulic power unit and configured to receive the fluid from the reservoir via the hydraulic power unit, pressurize the fluid, and deliver the pressurized fluid to the accumulator of the hydraulic power unit, wherein the hydraulic power unit is configured to receive the fluid from the reservoir, direct the fluid to the subsea pumping device, receive the pressurized fluid from the subsea pumping device, store the pressurized fluid in the accumulator, and control an output of the pressurized fluid via a control valve from the accumulator to the subsea well equipment, wherein the subsea pumping device comprises a high pressure pump and a low pressure pump disposed on a skid, the skid being configured to be carried by an ROV to a position proximate the hydraulic power unit on the seabed such that the subsea pumping device can be repeatedly fluidly connected to the hydraulic power unit subsea to refill the accumulator with the pressurized fluid.

2. An apparatus according to claim 1 wherein the reservoir is configured to provide hydraulic fluid for pressurization in the subsea pumping device and storage in the accumulator of the hydraulic power unit, and where the hydraulic power unit is configured to deliver the pressurized hydraulic fluid to the subsea equipment comprising a subsea tree for selective actuation of a plurality of hydraulic valves of the subsea tree in a workover operation.

3. An apparatus according to claim 1, further comprising a recirculation pump on the skid, the recirculation pump being configured to recirculate the fluid back to the reservoir.

4. An apparatus according to claim 1 wherein the accumulator of pressure unit comprises a plurality of bottles.

5. An apparatus according to claim 1 wherein the apparatus comprises at least a first, low pressure accumulator and a second, high pressure accumulator, the first accumulator being configured to store the pressurized fluid at a first pressure, and the second accumulator being configured to store the pressurized fluid at a second pressure higher than the first pressure, and wherein the apparatus is configured to provide the fluid to the subsea equipment at two different pressures.

6. An apparatus according to claim 1 wherein the reservoir is configured to provide a chemical fluid for the pressurization in the subsea pumping device and storage in the accumulator of the hydraulic power unit, and where the hydraulic power unit is configured to deliver the pressurized chemical fluid to the subsea equipment.

7. An apparatus according to claim 1, further comprising an umbilical for providing from a tied-back facility at least one of the group consisting of a replenishment supply of the fluid to the reservoir and power to the subsea pumping device.

8. An apparatus according to claim 1 wherein the apparatus is electrically connected to the subsea equipment and configured to provide to the equipment at least one of the group consisting of electrical power and communication signals.

9. A method of providing a controllable supply of fluid to a subsea well equipment, the method comprising:

storing a supply of fluid in a reservoir on a seabed for delivery to the subsea well equipment;

receiving the fluid from the reservoir in a subsea pumping device;

pumping the fluid from the pumping device to an accumulator of a hydraulic power unit disposed on the seabed wherein pumping the fluid comprises receiving the fluid at a high pressure pump and a low pressure pump of the pumping device disposed on a skid carried by an ROV;

storing the pressurized fluid in the accumulator controlling an output of the pressurized fluid from the hydraulic power unit to the subsea well equipment; and repeatedly moving the pumping device to a position proximate the hydraulic power unit on the seabed and fluidly connecting the pumping device to the hydraulic power unit subsea to refill the accumulator with the pressurized fluid.

* * * * *